United States Patent [19]

Watanabe et al.

[11] Patent Number: 4,984,996

[45] Date of Patent: Jan. 15, 1991

[54] PRINTED CIRCUIT BOARD EDGE CONNECTOR

[75] Inventors: Tetsuya Watanabe, Sagamihara; Yoshio Sato, Tsukui; Tsutomu Nakamura, Kawasaki; Naoki Kumagai, Machida; Takashi Kamono, Yokohama, all of Japan

[73] Assignee: AMP Incorporated, Harrisburg, Pa.

[21] Appl. No.: 550,602

[22] Filed: Jul. 10, 1990

[30] Foreign Application Priority Data

| | | | |
|---|---|---|---|
| Jul. 10, 1989 | [JP] | Japan | 1-177787 |
| Jul. 17, 1989 | [JP] | Japan | 1-184205 |
| Sep. 20, 1989 | [JP] | Japan | 1-244313 |

[51] Int. Cl.[5] ..... H01R 13/54

[52] U.S. Cl. ..... 439/326

[58] Field of Search ..... 439/296, 326–328, 439/629–637

[56] References Cited

U.S. PATENT DOCUMENTS

| | | | |
|---|---|---|---|
| 4,136,917 | 1/1979 | Then et al. | 439/326 |
| 4,713,013 | 12/1987 | Regnier et al. | 439/326 |

*Primary Examiner*—Joseph H. McGlynn

[57] ABSTRACT

An edge connector (5) for receiving an edge of a circuit board (6) is disclosed. The contacts (2) positioned in the housing (4) of the connector (5) include a resilient stand-up section (25) having a tip (25*a*) defining a first contact point (A) and a C-shaped section (26) having a tip (26*a*) defining a second contact point (C) with the circuit board (6) being received between the first and second contact points (A,C).

5 Claims, 3 Drawing Sheets

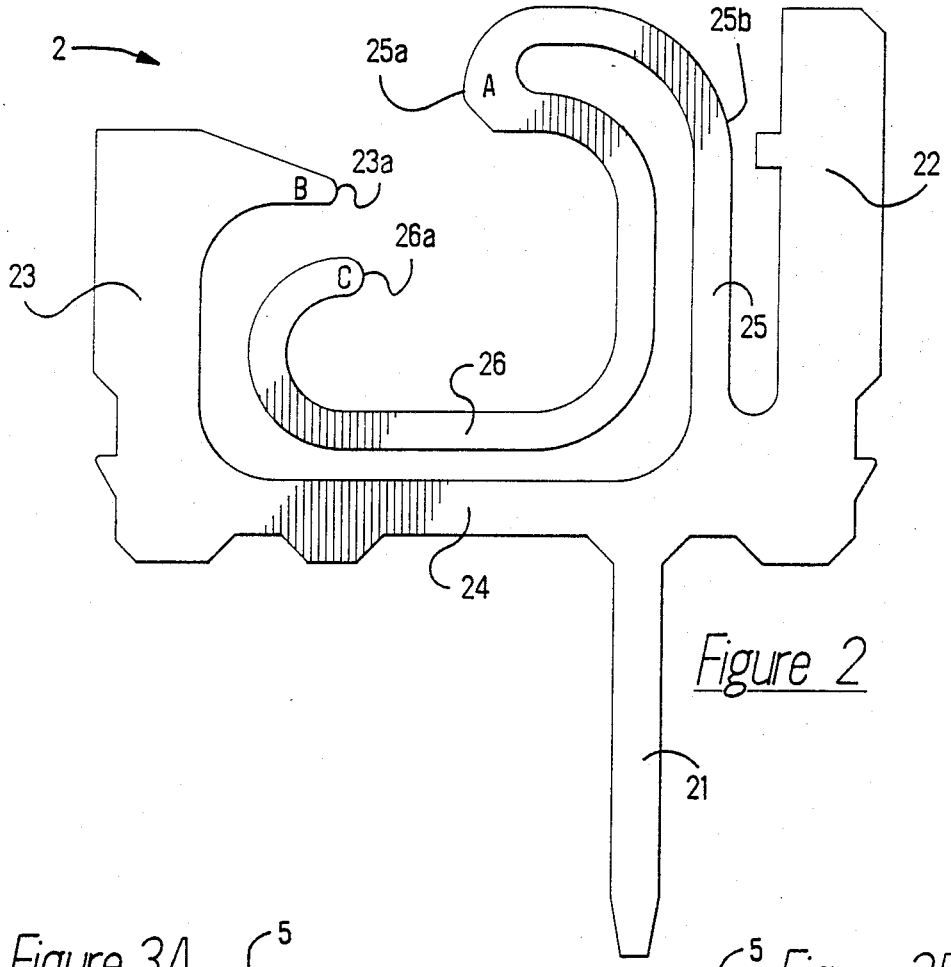
Figure 2
Figure 3A
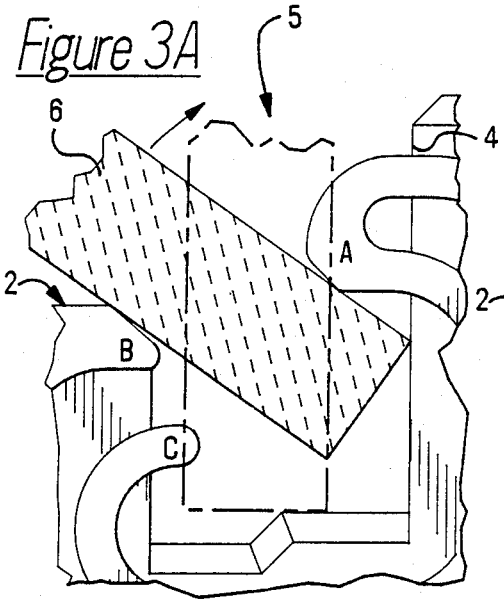
Figure 3B
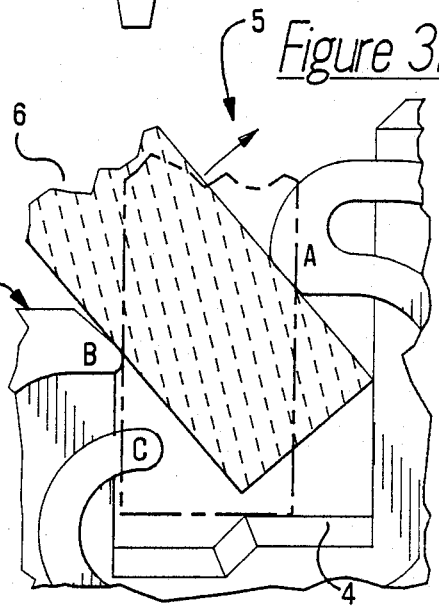

PRINTED CIRCUIT BOARD EDGE CONNECTOR

FIELD OF THE INVENTION

The present invention relates to a circuit board edge connector to receive an edge of a circuit board such as for example, a printed circuit board and to make an electrical connection between contact point(s) at the edge of such circuit board and other electric circuits.

BACKGROUND OF THE INVENTION

Various edge connectors of this type have been proposed and commercially available but are insufficient as an edge connector to accommodate various circuit boards (PCBs) of different board thickness. That is, resiliently deformable contacts in a connector to receive an edge of a PCB for making electrical connection are limited in the degree of deformation and cannot accommodate PCBs of two largely different thicknesses.

Additionally, PCBs can warp, which makes it more difficult for currently available connectors to accommodate them.

There is a low insertion force connector as one example of this type of edge connector disclosed in, for example, U.S. Pat. No. 4,737,120 in which a PCB is gripped between two opposite contact sections. However, one of said contact sections has essentially no room to deform and the other contact section is in a cantilever configuration with limited amount of deformation and tends to be permanently deformed at the base portion which is very close to its contact portion.

Also, disclosed in U.S. Pat. No. 3,848,952 is a zero insertion force edge connector having a C-shaped cantilever type contact disposed against a part of a PCB to distribute the contact stress. However, such connector is poor in dimensional accuracy because of the use of a part of the housing to cooperate with the PCB.

As for PCB standards, there are for example two standards, one is the U.S. standard with board thickness of $1.27\ {}_{-0.08}{}^{+0.1}$ mm and the other is the Japanese standard with board thickness of $1.2\ {}_{-0.12}{}^{+0.15}$ mm. There requires tolerance of about 0.3 mm to accommodate both standards and no edge connector having such tolerance can be met by the connector designs of the above U.S. patents.

The present invention intends to overcome the disadvantages of such conventional edge connector. It is, therefore, an object of the present invention to provide a highly accurate edge connector to accommodate PCBs with larger tolerances by distributing the stress to accept larger deformation and by not cooperating with a part of the housing by the contact.

SUMMARY OF THE INVENTION

The connector according to the present invention employs contacts resiliently deformable on contacting an edge portion of a printed circuit board, each contact integrally made of a resiliently deformable metal plate and comprising a tine section at the lower portion extending downwardly a horizontal base section having first and second supports extending upwardly from both ends of the base section, a stand-up section extending upwardly substantially parallel to the first end thereof and then to the second support, and a C-shaped section extending from the tip of the stand-up section sequentially along the stand-up section, the horizontal portion of the base section and the second support. The edge connector is characterized in that the tip of the stand-up section extends toward the second support to form a first contact point, the tip of the C-shaped section extends toward the first contact point to form a second contact point, an anti-overstress section is formed inside of the first support to restrict the deformation of the stand-up section by abutting against the outer surface of the stand-up section during insertion of the circuit board, and the circuit board received between the first and second contact points is rotated in the direction to increase the contact pressure between the circuit board and the second contact point for making an electrical connection with the printed circuit board.

DESCRIPTION OF THE DRAWINGS

FIG. 2 is a plan view of only the contact of the connector shown in FIG. 1;

FIG. 3A is a cross section view to illustrate the relationship between the connector and a relatively thin circuit board;

FIG. 3B is a cross section view to illustrate the relationship between the connector and a relatively thick circuit board.

DESCRIPTION OF THE INVENTION

An embodiment of the present invention will be described in detail hereunder by reference to the accompanying drawings.

Figure 1:
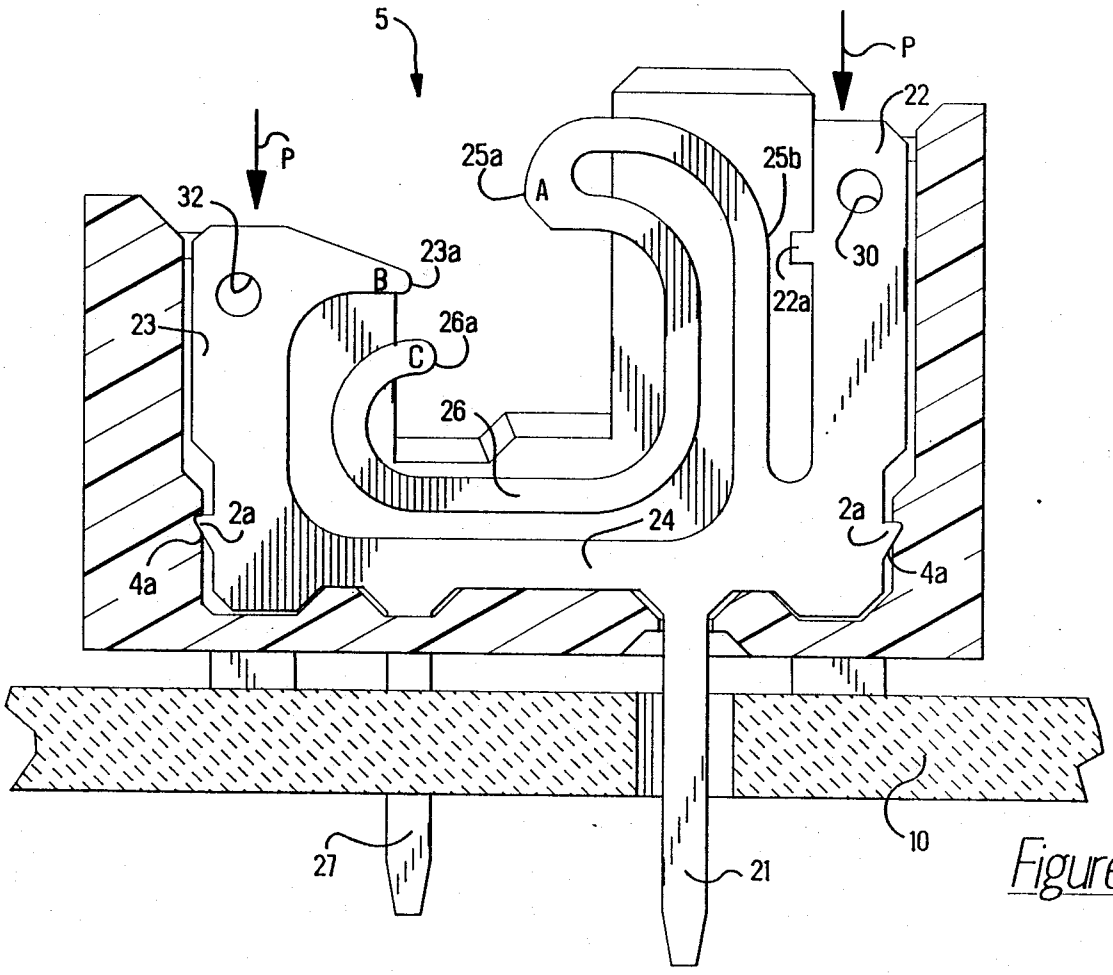
FIG. 1 is a cross sectional view of the connector of the present invention.

Illustrated in FIG. 1 is one embodiment of the present invention in which a contact 2 is retained in a housing 4 to form edge connector 5. The contact 2 is pushed into the housing 4 from the above as shown by the arrow and retained therein by the engagement between projections **2*a* at outer sides of the contact 2 and grooves 4*a* formed (or to be formed by the insertion) inside of the housing 4**.

As shown in FIG. 2, contact 2 is integrally made of a resiliently deformable metal plate and comprises a tine section 21 extending downwardly from the lower portion, a horizontal base section 24 having upwardly extending first and second supports 22,23 at both ends thereof, a stand-up section 25 disposed inside of and parallel to the first support 22 of the base member 24 and then curving toward the second support 23. Further a C-shaped section 26 extends from the tip **25*a* of the stand-up section 25, first paralleling the stand-up section 25 and then the horizontal portion of the base section 24 and then curving around inside the second support 23**.

Tip **25*a* of the stand-up section 25 extends toward the second support 23 to form a first contact point A. An inner side of a tip 23*a* of the second support 23 extends toward the first contact point 25*a* to define a projection B. Tip 26*a* of the C-shaped section 26 extends toward the first contact point A and forms second contact point C. There is formed an antioverstress section 22*a* inside of the first support 22 to restrict deformation of the stand-up section 25 by abutting it against the outer side surface 25*b*** during insertion of the circuit board. The circuit board inserted between the first and second contact points A,C is rotated against point A to increase the contact pressure for making electrical connection.

The printed circuit board 6 is inserted between the first contact point A and the second contact point C of the contact made as formed above and as illustrated by the solid line in FIGS. 3A and 3B. It is, then, rotated to the position as illustrated by the arrow and as illustrated by the chain line. In this position, sections 25 and 26, having respectively first contact point A and second contact point C, are resiliently deformed, thereby contacting the front and rear surfaces of the printed circuit board 6 with larger contact pressure.

This will allow the contact 2 to deform largely so as to accommodate printed circuit boards 6 of different board thickness. Also, the contact on both front and rear surfaces of the printed circuit board 6 with increased contact pressure will receive printed circuit boards of larger tolerance to provide a contact of reliable electrical connection.

If the circuit board 6 is thin (e.g., 1.08 mm), the circuit board 6 will be finally settled to the position as illustrated by the double dotted line in FIG. 3A, thereby allowing the contact points A and C to contact both surfaces of the substrate 6. However, if the circuit board is thick (e.g., 1.37 mm), the circuit board 6 contacts both contact points A and C as well as the projection 23*a* (B) as shown in FIG. 3B.

The projection 22*a* inside of the first support 22 abuts against the outer surface 25*b* of the stand-up section 25 and acts as anti-overstress means to prevent the stand-up section 25 from deforming excessively.

Represented by the reference number 21 in FIG. 1 is a tine section (21) of the contact 2 to be soldered to the circuit board 10. Also illustrated is a tine section 27 (which is staggered with the tine section 21) of a contact (not shown) adjacent the contact 2. However tine sections 21,27 can be replaced with surface mount feet (not shown) if desired.

Also shown in FIG. 1 are holes 30,32 in first and second supports 22,23 which are useful in assembling contacts 2 into housing 4.

Figure 4:
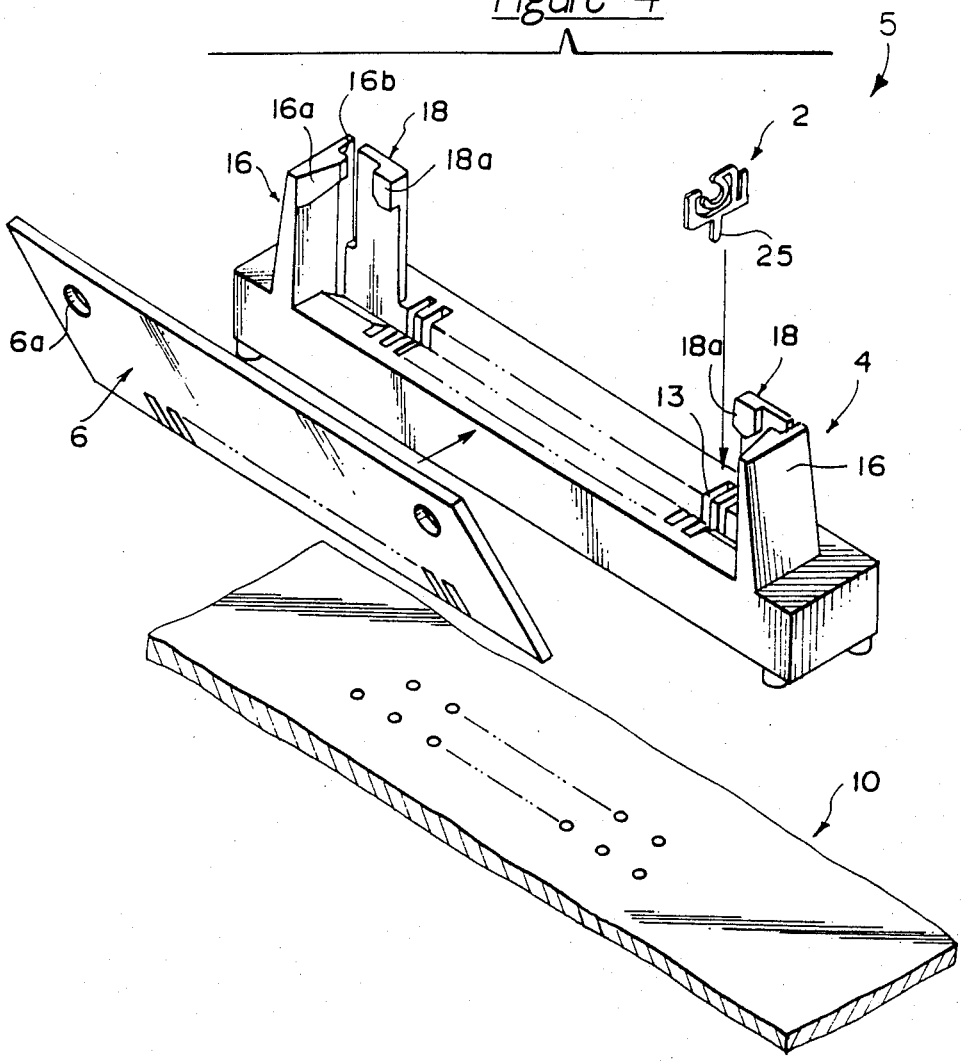
FIG. 4 is an exploded perspective view of the connector.

FIG. 4 shows an exploded perspective view of the connector of the above embodiment. A housing 4 of the connector is placed on the circuit board 10. A large number of contacts 2 (only one is shown) are inserted in slots 13 in the housing 4. Then, the printed circuit board 6 is inserted therein. When inserting the printed circuit board 6, it is inserted in a slanted manner between a pair of retainers 16 provided vertically at both ends of the connector housing 4. It is pressed into the vertical position along tapered sections 16*a* formed on the inner surfaces of the retainers 16. In the vertical position, the printed circuit board 6 is mated with stepped sections 16*b* behind the tapered section 16*a*, thereby restoring the pair of retention sections 16 into their normal vertical positions from the resiliently outwardly deflected positions during insertion of the printed circuit board 6. The printed circuit board 6 is, then, retained. In the shown example, a pair of locking apertures 6*a* at both ends of the printed circuit board 6 mate with a pair of locking projections 18*a* provided adjacent to the retention sections 16 at both ends of the housing 4, thereby preventing the printed circuit board 6 from being removed in the vertical direction.

Although the anti-overstress projection 22*a* is formed on the first support 22 of the contact 2 to protect excessive deformation of the stand-up section 25 as mentioned hereinbefore, the anti-overstress means is not necessarily in this particular construction. It is enough that the inner surface of the first support 22 abuts against the outer side surface 25*a* of the stand-up section 25 to protect the overstress of the stand-up section 25. For example, the inner surface of the first support 22 may be flat and the outer side surface 25*a* of the stand-up section 25 may be partly raised.

Each contact for the edge connector according to the present invention is integrally made of a single metal plate as mentioned above. Also, when the printed circuit board is rotated to increase contact pressure between the third contact point and the contact point on the printed circuit board, stress is distributed over these contacts, thereby making such contact to withstand larger deformation. This allows the contact to accommodate printed circuit boards with larger tolerance and of largely different standards.

Additionally, the edge connector according to the present invention protects the largely deformable C-shaped section inside of the contact base section having the second contact point at the tip thereof.

We claim:

1. In an edge connector (5) to receive an edge of a circuit board (6) to interconnect contact points on said circuit board (6) with other electrical circuits, a circuit board edge connector (5) comprising a housing (4) and contact(s) (2) disposed in said housing (4) characterised in that:

each of said contacts (2) is integrally made of a resiliently deformable metal plate comprising a tine section (21,27) extending downwardly, a horizontal base section (24) having upwardly extending first and second supports (22,23) at both ends thereof, a stand-up section (25) extending upwardly from said base section (24) inside of said first support (22) and then curving toward said second support (23) and a C-shaped section (26) extending downwardly in a C-shaped manner from the tip (25*a*) of said stand-up section (25) in a U-shape and sequentially along said stand-up section (25), the horizontal portion of said base section (24), and said second support (23);

the tip (25*a*) of said stand-up section extends toward said second support (23) to define a first contact point (A); and the tip (26*a*) of said C-shaped section (26) extends toward said first contact point to define a second contact point (C) with said circuit board (6) being received between said first and second contact points (A,C).

2. The edge connector (5) according to claim 1 further characterised in that an anti-overstress section is formed inside of said first support (22) to abut against the outer side surface of said stand-up section (25) during insertion of the circuit board (6) for restricting the displacement of said stand-up section (25).

3. The edge connector (5) according to claim 2 further characterised in that the second support (23) includes a tip (23*a*) facing the stand-up section (25).

4. The edge connector (5) according to claim 1 further characterised in that the housing (4) includes at each end a resilient retainer (16) having a stepped section (16*b*) for retaining the circuit board (6) in the connector (5).

5. The edge connector (5) according to claim 4 further characterised in that the housing (4) includes locking projections (18*a*) for entering apertures (6*a*) in the circuit board (6).

* * * * *